US009071914B2

(12) United States Patent
Shennib

(10) Patent No.: US 9,071,914 B2
(45) Date of Patent: Jun. 30, 2015

(54) COMBINED MICROPHONE AND RECEIVER ASSEMBLY FOR EXTENDED WEAR CANAL HEARING DEVICES

(75) Inventor: Adnan Shennib, Dublin, CA (US)

(73) Assignee: InSound Medical, Inc., Newark, CA (US)

( * ) Notice: Subject to any disclaimer, the term of this patent is extended or adjusted under 35 U.S.C. 154(b) by 1633 days.

(21) Appl. No.: 12/191,136

(22) Filed: Aug. 13, 2008

(65) Prior Publication Data

US 2009/0074220 A1 Mar. 19, 2009

Related U.S. Application Data

(60) Provisional application No. 60/955,755, filed on Aug. 14, 2007.

(51) Int. Cl.
*H04R 25/00* (2006.01)
*H04R 25/02* (2006.01)

(52) U.S. Cl.
CPC ..... *H04R 25/02* (2013.01); *H04R 25/456* (2013.01); *H04R 2225/023* (2013.01)

(58) Field of Classification Search
USPC ..... 381/322–330, 312, 315; 181/129, 130
See application file for complete search history.

(56) References Cited

U.S. PATENT DOCUMENTS 3,061,689 A 10/1962 McCarrell et al.
RE26,258 E 8/1967 Martin
3,414,685 A 12/1968 Geib et al.
3,527,901 A 9/1970 Geib
3,594,514 A 7/1971 Wingrove
3,764,748 A 10/1973 Branch et al.
3,783,201 A 1/1974 Weiss et al.
3,865,998 A 2/1975 Weiss et al.
3,870,832 A 3/1975 Fredrickson
3,882,285 A 5/1975 Nunley et al.
4,442,917 A 4/1984 Johnson
4,539,440 A 9/1985 Sciarra
4,606,329 A 8/1986 Hough
4,607,720 A 8/1986 Hardt
4,628,907 A 12/1986 Epley
4,639,556 A 1/1987 Hartl et al.

(Continued)

OTHER PUBLICATIONS

International Search Report and Written Opinion of PCT Application No. PCT/US2008/073065, dated Oct. 22, 2008, 8 pages total.

(Continued)

*Primary Examiner* — Bradley K Smith
*Assistant Examiner* — David Goodwin
(74) *Attorney, Agent, or Firm* — Henricks, Slavin & Holmes LLP

(57) ABSTRACT

An ultra miniature hearing device for extended wear entirely in the ear canal past the cartilaginous region is provided. The hearing device comprises a microphone and a speaker, each having a respective diaphragm. The speaker and microphone are placed parallel to each other in a single lateral assembly. The microphone and speaker can be arranged such that their diaphragms are orthogonal to one another so that cross coupling of vibrations is minimized, thus reducing internal feedback. Due to the parallel co-placement of the speaker and microphone in the single lateral assembly, the length of the device is substantially shorter than that of prior hearing aid devices. The hearing device is 12 mm or less in length to fit in the bony part of the ear canal for most individuals and is placed within approximately 3 mm from the eardrum.

22 Claims, 3 Drawing Sheets

(56) References Cited

U.S. PATENT DOCUMENTS

| | | | | |
|---|---|---|---|---|
| 4,680,799 | A | 7/1987 | Henneberger | |
| 4,756,312 | A | 7/1988 | Epley | |
| 4,776,322 | A | 10/1988 | Hough et al. | |
| 4,817,607 | A | 4/1989 | Tatge | |
| 4,830,139 | A | 5/1989 | Cirillo | |
| 4,840,178 | A | 6/1989 | Heide et al. | |
| 4,870,688 | A | 9/1989 | Voroba et al. | |
| 4,880,076 | A | 11/1989 | Ahlberg et al. | |
| 4,937,876 | A | 6/1990 | Biermans | |
| 4,957,478 | A | 9/1990 | Maniglia | |
| 4,969,534 | A | 11/1990 | Kolpe et al. | |
| 5,002,151 | A | 3/1991 | Oliveira et al. | |
| 5,015,224 | A | 5/1991 | Maniglia | |
| 5,015,225 | A | 5/1991 | Hough et al. | |
| 5,031,219 | A | 7/1991 | Ward et al. | |
| 5,163,957 | A | 11/1992 | Sadé et al. | |
| 5,185,802 | A | 2/1993 | Stanton | |
| 5,195,139 | A | 3/1993 | Gauthier | |
| 5,201,007 | A | 4/1993 | Ward et al. | |
| 5,201,008 | A | 4/1993 | Arndt et al. | |
| 5,220,612 | A | 6/1993 | Tibbetts et al. | |
| 5,220,918 | A | 6/1993 | Heide et al. | |
| 5,259,032 | A | 11/1993 | Perkins et al. | |
| 5,282,858 | A | 2/1994 | Bisch et al. | |
| 5,338,287 | A | 8/1994 | Miller et al. | |
| 5,390,254 | A | 2/1995 | Adelman | |
| 5,425,104 | A | 6/1995 | Shennib | |
| 5,430,801 | A | 7/1995 | Hill | |
| 5,456,654 | A | 10/1995 | Ball | |
| 5,530,763 | A * | 6/1996 | Aebi et al. | 381/322 |
| 5,531,787 | A | 7/1996 | Lesinski et al. | |
| 5,554,096 | A | 9/1996 | Ball | |
| 5,572,594 | A | 11/1996 | Devoe et al. | |
| 5,624,376 | A | 4/1997 | Ball et al. | |
| 5,654,530 | A | 8/1997 | Sauer et al. | |
| 5,659,621 | A | 8/1997 | Newton | |
| 5,682,020 | A | 10/1997 | Oliveira | |
| 5,701,348 | A | 12/1997 | Shennib et al. | |
| 5,724,431 | A | 3/1998 | Reiter et al. | |
| 5,742,692 | A * | 4/1998 | Garcia et al. | 381/328 |
| 5,825,896 | A | 10/1998 | Leedom | |
| 5,833,626 | A | 11/1998 | Leysieffer | |
| 5,949,895 | A | 9/1999 | Ball et al. | |
| 5,982,908 | A * | 11/1999 | Bauman | 381/325 |
| 6,058,198 | A | 5/2000 | Aceti | |
| 6,068,589 | A | 5/2000 | Neukermans | |
| 6,137,889 | A | 10/2000 | Shennib et al. | |
| 6,208,741 | B1 | 3/2001 | Shennib et al. | |
| 6,212,283 | B1 | 4/2001 | Fletcher | |
| 6,229,900 | B1 | 5/2001 | Leenen | |
| 6,359,993 | B2 | 3/2002 | Brimhall | |
| 6,408,081 | B1 | 6/2002 | Boesen | |
| 6,473,511 | B1 | 10/2002 | Aceti | |
| 6,473,513 | B1 | 10/2002 | Shennib et al. | |
| 6,516,074 | B1 * | 2/2003 | Brimhall et al. | 381/322 |
| 6,567,527 | B1 * | 5/2003 | Baker et al. | 381/323 |
| 6,595,796 | B1 | 7/2003 | Koegel | |
| 6,620,110 | B2 | 9/2003 | Schmid | |
| 6,643,378 | B2 | 11/2003 | Schumaier | |
| 6,648,813 | B2 | 11/2003 | Zilberman et al. | |
| 6,658,126 | B1 | 12/2003 | Stern | |
| 6,940,988 | B1 | 9/2005 | Shennib et al. | |
| 7,215,789 | B2 | 5/2007 | Shennib et al. | |
| 7,221,768 | B2 * | 5/2007 | Sjursen et al. | 381/322 |
| 7,310,426 | B2 * | 12/2007 | Shennib et al. | 381/328 |
| 7,580,537 | B2 * | 8/2009 | Urso et al. | 381/322 |
| 7,912,240 | B2 * | 3/2011 | Madaffari et al. | 381/420 |
| 2002/0074997 | A1 | 6/2002 | Smith, Jr. et al. | |
| 2002/0085728 | A1 | 7/2002 | Shennib et al. | |
| 2006/0050914 | A1 | 3/2006 | Urso et al. | |
| 2006/0098833 | A1 * | 5/2006 | Juneau et al. | 381/328 |
| 2006/0133631 | A1 * | 6/2006 | Harvey et al. | 381/312 |
| 2006/0153418 | A1 | 7/2006 | Van Halteren | |
| 2006/0159298 | A1 | 7/2006 | von Dombrowski et al. | |
| 2007/0121974 | A1 | 5/2007 | Nemirovski | |
| 2008/0205679 | A1 * | 8/2008 | Darbut et al. | 381/328 |

OTHER PUBLICATIONS

US 5,730,699, 03/1998, Adams et al. (withdrawn)

* cited by examiner

COMBINED MICROPHONE AND RECEIVER ASSEMBLY FOR EXTENDED WEAR CANAL HEARING DEVICES

CROSS-REFERENCES TO RELATED APPLICATIONS

The present invention claims the benefit of U.S. Provisional Patent Application No. 60/955,755, filed on Aug. 14, 2007 and entitled "Combined Microphone and Receiver Assembly For Extended Wear Canal Hearing Devices". The present invention also is related to the following commonly assigned U.S. Pat. No. 7,215,789, issued May 8, 2007; U.S. Pat. No. 6,940,988, issued Sep. 6, 2005; U.S. Pat. No. 6,567,527, issued May 20, 2003; and U.S. Pat. No. 6,473,513, issued Oct. 29, 2002. The contents of these patent applications and patents are fully incorporated herein by reference.

BACKGROUND OF THE INVENTION

The present invention relates to hearing devices. More specifically, the present invention relates to hearing devices that are worn entirely in the ear canal for extended wear without daily insertion and removal as required with conventional hearing aids.

The external acoustic meatus (ear canal) is generally narrow and contoured as shown in the coronal view in FIG. 1. The ear canal 10 is axially approximately 25 mm in length from the canal aperture 15 to the tympanic membrane or eardrum 18. The lateral part, the part away from the tympanic membrane, of the ear canal comprises a cartilaginous region 11. Cartilaginous region 11 is relatively soft due to the underlying cartilaginous tissue. Cartilaginous region 11 of the ear canal 10 deforms and moves in response to the mandibular or jaw motions, which occur during talking, yawning, eating, etc. The medial part, the part toward the tympanic membrane, comprises a bony region 12. Bony region 12 is proximal to the tympanic membrane and is rigid. Bony region 12 or the "bony canal" is roughly 15 mm long, representing approximately 60% of the canal length. The skin in the bony region 12 is thin relative to the skin in the cartilaginous region and thus more sensitive to touch or pressure. There is a characteristic bend that occurs approximately at the bony-cartilaginous junction 17, which separates cartilaginous region 11 and from bony region 12.

Hair 5 and debris 3 in the ear canal are primarily present in the cartilaginous region 11. Physiologic debris includes cerumen or earwax, sweat, decayed hair, and oils produced by the various glands underneath the skin in the cartilaginous region. Non-physiologic debris is also present and may consist of environmental particles, including hygienic and cosmetic products, that may have entered the ear canal. Canal debris is naturally extruded to the outside of the ear by the process of lateral epithelial cell migration, offering a natural self-cleansing mechanism for the ear.

The ear canal 10 terminates medially with the tympanic membrane 18. Lateral of and external to the ear canal is the concha cavity 2 and the auricle 4, which is cartilaginous. The junction between the concha cavity 2 and cartilaginous region 11 of the ear canal at the aperture 15 is also defined by a characteristic bend 7, which is known as the first bend of the ear canal. Canal shape and dimensions can vary significantly among individuals.

When compared to cartilaginous region 11, bony region 12 is dimensionally more stable since the underlying tissue is osseous and also physiologically less active due to the absence of hair, cerumen or sweat glands, present only in the cartilaginous portion.

Extended wear hearing devices, such as those described in U.S. Pat. No. 7,215,789 to Shennib et al., U.S. Pat. No. 6,940,988 to Shennib et al., U.S. Pat. No. 6,473,513 also to Shennib et al., are worn continuously from several weeks to several months inside the ear canal. These devices, as taught by Shennib et al., may be miniature in size in order to fit entirely within the ear canal and are adapted for the receiver to fit deeply in the ear canal in proximity to the tympanic membrane (TM). However, the devices as taught may extend into the cartilaginous portion of the ear canal.

An optimized placement for these devices is entirely in the bony part of the ear canal, avoiding placement in the cartilaginous portion of the ear canal. Placement in this manner may be desirable for many reasons including: (1) stability—because the bony part is immobile and the cartilaginous part is subject to movements and deformations, which can interfere with the hearing device by moving it or dislodging it from its intended position; (2) comfort of wear—canal interference with the hearing device can cause discomfort, irritation and even laceration of the ear canal; and (3) device longevity—because physiological debris is present primarily in the cartilaginous part of the ear canal, placement of the device in the bony canal can reduce the probability of contamination by debris in the canal.

In order to avoid placement of the device in the cartilaginous area of the ear canal, the hearing device should be made sufficiently short to fit only in the bony part between the junction 17 and the tympanic membrane 18. Therefore, the hearing device should be considerably shorter than 15 mm to fit most individuals in the bony region only and allowing for safe distance from the tympanic membrane. Many hearing devices, including the extended wear devices mentioned above, are too long and do not fit entirely in the bony canal. Many inventions provide various methods for dealing with partial placement in the cartilaginous part of the ear canal. These methods include the suspension of a lateral assembly and articulation of the device as will be discussed in more details below.

Hearing aid receiver (referred to here alternatively as speakers) may be highly miniaturized but sufficiently sized to efficiently produce amplified sound to the tympanic membrane. These speakers are generally in the shape of a rectangular prism with lengths in the range of 5-7 mm and 2-3 mm in girth at the narrowest dimension. These speakers confer substantial length to the hearing device. Smaller dimensions are possible to manufacture but generally lead to undesirable reduction in output efficiency and are thus not currently commercially available. The reduction in output efficiency may not be acceptable for hearing aid manufacturers since the output efficiency reduction may necessitate increasing the power consumption significantly to produce the required amplification level for a hearing impaired individual. Examples of miniature hearing aid speakers include FH and FK series receivers made by Knowles Electronics and series 2600 made by Sonion (Denmark).

Miniature microphones for hearing aids also exist with form factors that confer length or bulk to the miniature hearing devices. These miniature microphones are generally in rectangular prism shape or in cylindrical shape, ranging from 2.5-5 in length to 1.3- to 2.6 mm in the narrowest dimension. Examples of miniature microphone include FG and TO series by Knowles Electronics, series 6000 by Sonion, and series 151 by Tibbetts Industries. Electret type microphones are widely used in hearing aids for their superior sensitivity, low noise characteristics and wide dynamic range. Electret type microphones can also have good vibration rejection characteristics for minimizing the effects of speaker or shell-conducted vibrations. Silicon microphones, not yet widely used, promise improved miniaturization and reduced vibration sensitivity. Similarly, smaller microphones can be manufactured but generally at the expense of reduced sensitivity and increased noise levels. Resorting to smaller microphone with inferior specifications is seldom acceptable by hearing impaired users who demand improved sound fidelity.

In canal hearing aid devices, conventional and extended wear types, the transducers (speaker and microphone) are positioned with extreme care with respect to one another to minimize the occurrence of internal and external "feedback" generation. Feedback is the unwanted whistling in a hearing device due to the coupling between the microphone and receiver. Basically, feedback occurs when a portion of the output energy from the receiver reaches the microphone and causes a self-sustained oscillation. Causes and mitigation of feedback in hearing devices are discussed in more details in columns 9 and 10 of U.S. Pat. No. 5,701,348, the contents of which are fully incorporated herein by reference. The opportunity for feedback is directly proportional to the acoustic gain (volume) and may thus be more likely to occur in hearing devices for persons with significant hearing losses. Feedback is also more likely to occur as the device gets smaller due to the reduction of the distance and increased coupling between the transducers.

To minimize feedback in miniature canal hearing devices, the speaker and the microphone can be placed with maximum axial spatial separation to minimize sound and vibration cross coupling. For example, in FIGS. 3-5 of commonly owned U.S. Pat. No. 6,940,988 and FIGS. 3 and 5 of commonly owned U.S. Pat. No. 7,215,789, the speaker or receiver is placed most medially toward the tympanic membrane and the microphone is placed most laterally toward the aperture 15 of the ear canal. By maximizing the axial spatial separation between the speaker and the microphone, higher feedback-free amplification levels can be achieved. Another method used in hearing devices to minimize feedback is the use of damping material to suspend or isolate the microphone and the speaker within the housing of the device, for example, by using viscoelastic material to encapsulate vibration sensitive components or by filling the space within the hearing device as described in U.S. Pat. No. 4,969,534, the contents of which are fully incorporated herein by reference. However, even with the use of optimal damping material and techniques, maximum spatial separation between the transducers is often necessary for the mitigation of feedback. This separation requirement may result in hearing devices considerably longer than 12 mm when considering other components needed to operate the device such as battery, amplifiers, electronic circuits, mounting parts, etc. Lengths in excess of 12 mm may be acceptable for a user-inserted hearing devices which may also be referred to here as daily wear devices. However, for extended wear canal hearing devices designed to operate continuously in the ear canal for up to several months, lengths exceeding 12 mm will often place the device partially in the cartilaginous portion of the ear canal when considering the need for approximately 3 mm of safety gap between the device and the tympanic membrane.

In prior hearing devices, such as those described in FIG. 4 of commonly owned U.S. Pat. No. 6,940,988 and FIG. 5 of commonly owned U.S. Pat. No. 6,473,513, mitigation of canal interference may be accomplished by suspending (in a non-contact or minimum contact fashion) the lateral assembly within the cartilaginous canal. The suspension may provide clearance for the device most of the time but occasionally the user may experience transient interference, for example, during yawing or sleeping on the ear, which may lead to device movement and in some cases discomfort. A transient interference can cause irritation of the skin in the bony canal, which is extremely sensitive to touch and movements. Large device movements due to canal deformations can also lead to dislodgment of the device from its intended position. Interference and device movements usually necessitate the untimely removal of the device from the ear canal prior to device end of life.

To facilitate the insertion of an extended wear device and to mitigate the effects of canal deformations, prior extended wear devices may use articulated assemblies with flexibly joints, for example, flexible connection 79 in commonly owned U.S. Pat. No. 7,215,789. This articulation can allow the lateral assembly to move in response to canal deformations or due to accumulation of debris in the cartilaginous portion. However, this articulation often adds length, cost and complexity to the manufacturing process of the device.

It is the objective of this invention to provide a shorter hearing device that fits entirely in the bony part of the ear canal for improved comfort, stability and durability.

Another objective is to provide an extended wear canal device which is not susceptible to canal movements and deformation present in the cartilaginous canal.

Another objective of this invention is to provide a hearing device that is 12 mm or less in length for fitting substantially in the bony part of the ear canal past the bony-cartilaginous junction when inserted within.

Yet, another objective of this invention is to provide an arrangement for an extended wear canal device without articulation for improved cost and reliability and shorter length.

SUMMARY OF THE INVENTION

The present invention relates to medical systems, devices, and methods. More specifically, the invention provides systems, devices, and methods for improving hearing. Embodiments of the invention provide an ultra miniature hearing device adapted to be worn for extended periods entirely in the ear canal past the cartilaginous region. The small size of the hearing device and its placement entirely within the ear canal provides a user with a more aesthetically pleasing and more natural appearance. The hearing device is adapted to be placed in the bony part of the ear canal, preferably by a physician or hearing professional. Placement of the device in the bony part of the hearing canal allows the hearing device to maintain a stable position and provide a comfortable fit by avoiding canal movements and deformations present in the cartilaginous region of the ear canal. Such placement also allows the hearing device to avoid contamination by debris in the cartilaginous region of the ear canal and therefore be more durable and have a longer life. Embodiments of the invention also provide means by which unwanted feedback in the hearing device can be reduced and even eliminated. The hearing device comprises a microphone having a microphone diaphragm and a speaker having a speaker diaphragm. The microphone is placed axially in parallel to the speaker, thereby reducing the space occupied by the hearing device. The microphone and speaker can be arranged so that the microphone diaphragm is orthogonal to the speaker diaphragm, thus minimizing the sensitivity of the microphone to vibrations produced by the receiver.

As used herein, the term "lateral" refers to the direction and parts of hearing devices which face away from the tympanic membrane. As used herein, the term "medial" refers to the direction and parts of hearing devices which face toward tympanic membrane.

A first aspect of the invention provides a hearing device for placement entirely in the ear canal for extended wear therein. The hearing device comprises (a) a power source, (b) an amplifier, (c) a microphone, and (d) a speaker. The microphone has a microphone diaphragm responsive to sound entering the ear canal. The speaker has a speaker diaphragm for generating amplified sound. The microphone and speaker are combined adjacently in an assembly disposed within a lateral portion of the hearing device and arranged so as to minimize cross vibrations from the speaker to the microphone when the speaker is excited by said amplifier. For example, the speaker and said microphone may be arranged so that the microphone diaphragm and the speaker diaphragm are positioned in orthogonal planes.

The power source may comprise a battery optionally having oval cross section and tapered medial end.

In many embodiments, an acoustic output of said speaker is acoustically coupled to a residual volume between a medial end of the hearing device and the tympanic membrane via a narrow sound conducting channel. The sound conducting channel may comprise a tube optionally having D-shaped cross section having an inside short diameter of 1 mm or less.

The hearing device may have a length 12 mm or less as measured from a lateral end to a medial end of the hearing device when the hearing device is placed entirely in the ear canal for extended wear therein. The microphone and speaker may be disposed at the lateral end, often forming the lateral end.

The hearing device may be adapted to be placed entirely in the bony part of the ear canal.

The speaker may comprise a dual diaphragm for reducing speaker case vibrations.

The hearing device may be adapted to be disposable and discarded after at least two months of wear in the ear canal.

The components within the hearing device may be encapsulated and proofed to withstand water and debris present in the ear canal.

The hearing device may further comprise a viscoelastic damper disposed between the microphone and the speaker. The viscoelastic damper is adapted to reduce vibration coupling therebetween.

The hearing device may be adapted to be positioned in the ear canal by a physician or a hearing aid professional.

Another aspect of the invention provides an extended wear hearing device for placement entirely in the bony part of the ear canal. The hearing device comprises a transducer assembly which comprises (a) a speaker and (b) a microphone adjacent to the speaker. The speaker has a speaker diaphragm for producing audible vibrations. The microphone has a microphone diaphragm oriented substantially orthogonal to the speaker diaphragm. A length of said extended wear hearing device is 12 mm or less by virtue of parallel co-placement of the microphone and the receiver within a combined assembly. This length allows for the device to be fit exclusively in the bony part of the ear canal and not subject to mobility and deformations present in the cartilaginous portion of the ear canal when said hearing device is placed in the ear canal for extended wear within. The hearing device may be adapted to be worn in the ear canal for at least 2 months.

Another aspect of the invention provides an extended wear hearing device for placement entirely in the bony part of the ear canal. The hearing device comprises (a) a speaker and (b) a microphone. The speaker has a speaker diaphragm for producing audible vibrations. The microphone has a microphone diaphragm oriented substantially orthogonal to the speaker diaphragm. The microphone is placed axially in parallel to the speaker. The extended wear hearing device is placed in the ear canal by a physician or a hearing professional to achieve safe placement within approximately 3 mm from the tympanic membrane.

Another aspect of the invention provides a method for minimizing feedback caused by an acoustic coupling of a microphone and a receiver in a hearing device. The microphone and the receiver are placed axially in parallel. The microphone and the receiver are positioned in relation to each other so as to place a microphone diaphragm of the microphone orthogonal to a receiver diaphragm of the receiver. Orthogonal placement of the microphone diaphragm in relation to the receiver diaphragm minimizes cross vibrations between the speaker and the microphone.

DETAILED DESCRIPTION OF THE INVENTION

Figure 1:
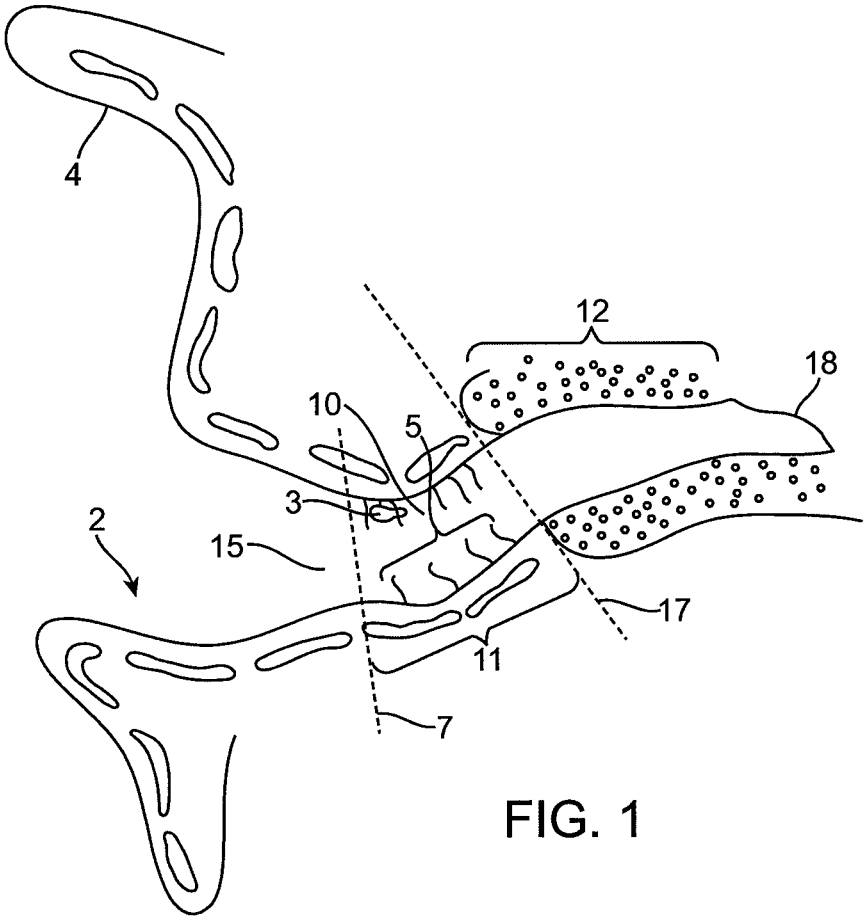
FIG. 1 shows anatomical features of the ear and ear canal.
Figure 2:
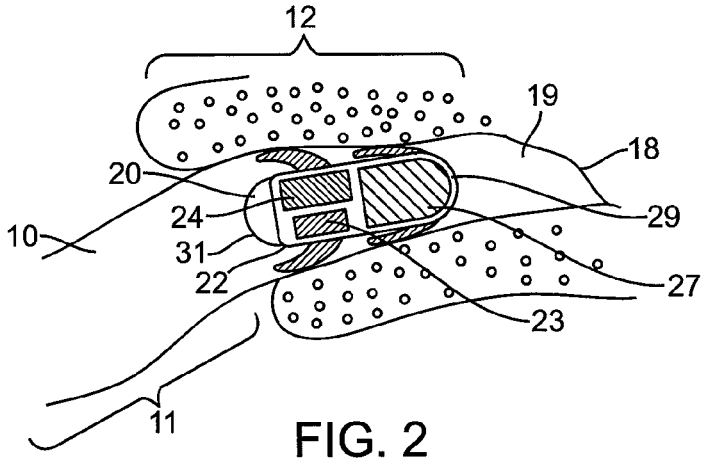
FIG. 2 shows an exemplary hearing device placed into the ear canal according to embodiments of the invention.
Figure 3:
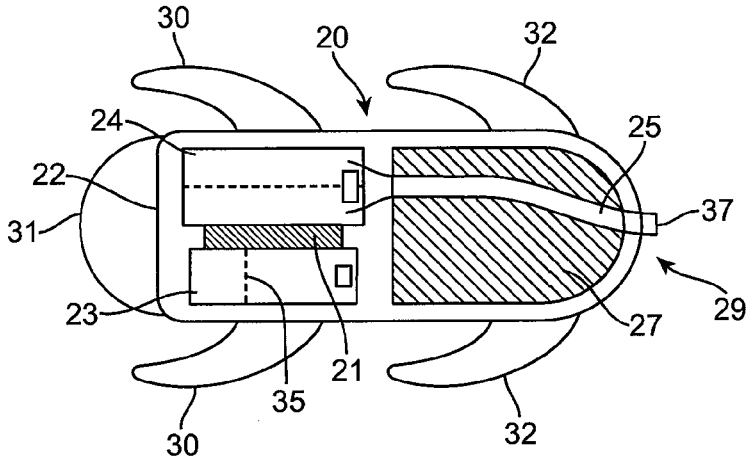
FIG. 3 shows a side, cross sectional view of the hearing device of FIG. 2.
Figure 4:
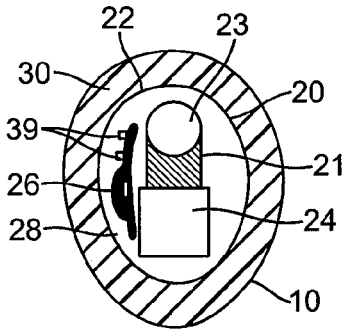
FIG. 4 shows a cross sectional view of the hearing device of FIG. 2.

FIGS. 2-4 show an exemplary hearing device 20 according to embodiments of the invention. Hearing device 20 is highly miniaturized for placement entirely in the bony part 12 of the ear canal 10 for extended wear therein. Since there is minimal debris and no canal deformations in the bony part 12 of the ear canal, hearing device 20 can remain functional and stable in the ear canal for longer periods exceeding 2 months. Hearing device 20 is highly energy efficient and can thereby eliminate resorting to daily insertion and removal as is the case with conventional daily wear devices. A novel approach is taken in embodiments of the present invention to minimize the length of the hearing device. The approach comprises placing the speaker (receiver) 24 axially in parallel to the microphone 23 within a lateral assembly 22. Lateral assembly 22 can be adapted to face away from tympanic membrane 18 when hearing device 20 is placed in the ear canal. Sound may be conducted from the speaker 24 medially to the residual volume 19 between a medial end 29 and the tympanic membrane 18 via sound conduit 25. Medial end 29 can be adapted to face tympanic membrane 18 when hearing device 20 is placed in the ear canal. The microphone and receiver can be combined within a unitary electronic assembly without resorting to axial separation. Feedback mitigation can be accomplished by orthogonal placement of the diaphragms of the transducers (the speaker and the microphone) as will be described further below. As used herein, the term "lateral" refers to the direction facing away from tympanic membrane 18 and the term "medial" refers to the direction facing toward tympanic membrane 18.

Figure 6:
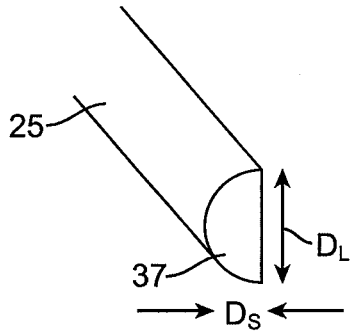
FIG. 6 shows a cross sectional view of a sound conduction tube according to embodiments of the invention.

As shown in FIG. 4, the lateral assembly 22 also comprises a flexible circuit 28. Flexible circuit 28 contains an integrated circuit or amplifier 26 and other discrete components 39. In a preferred embodiment, a battery 27 can be medially positioned with a low profile sound conduit 25 preferably having a half-pipe (D-shaped) cross section for carrying sound from receiver 24 to the medial end 29 of the hearing device 20 via sound opening 37 as shown in FIG. 6. The lateral combined assembly 22 can be connected to the battery assembly 37 preferably without articulation but optionally with articulation if so desired. Lateral acoustic seal 30 and medial seal 32 may secure the device 20 in the bony ear canal and can provide acoustic attenuation to mitigate occurrence of feedback.

Figure 5:
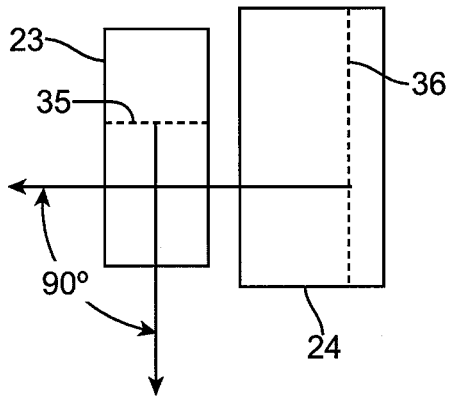
FIG. 5 shows the relative positioning of a speaker diaphragm and microphone diaphragm according to embodiments of the invention.

A basic principle of the invention is the precise orthogonal placement of the speaker diaphragm 36 with respect to microphone diaphragm 35 as shown in FIGS. 3 and 5. This orthogonal arrangement of the diaphragms can result in minimizing the sensitivity of the microphone to vibrations produced by the receiver. Generally speaking, the cross coupling is directly proportional to the cosine of the angle between the planes of the diaphragms with 90° degrees resulting theoretically in zero cross coupling. Since vibration vectors may not be exactly perpendicular across all audio frequencies, due to the complex patterns of vibrations and diaphragm deformations at a particular frequency, the optimal placement of the microphone with respect to the speaker may be slightly off 90° degrees to obtain minimal cross coupling for feedback control. The exact angle of placement may be derived by mathematically by methods such as finite-element-analysis (FEA) or empirically derived by experimentation for particular models of a transducer pair. The desired diaphragm arrangement may be expected to be at or be close to 90°, resulting in a microphone being responsive primarily to incident sound waves and relatively insensitive to vibrations from the speaker even though it is adjacently positioned. The orthogonal placement of transducer diaphragms can eliminate the conventional requirement of providing spatial separation, particularly along the axial dimension of the hearing device.

FIG. 4 shows a viscoelastic damper 21 which may be preferably included to separate the microphone 23 and the adjacently positioned receiver 24. To further reduce vibrational effects, a low vibration speaker incorporating dual diaphragm (not shown) may be used to minimize speaker vibrations. A dual diaphragm receiver relies on two parallel diaphragms arranged to move in opposite directions to cancel out case vibration effects while boosting the acoustic output.

In an exemplary embodiment shown in FIG. 4, the microphone 23 can be cylindrical type such as FG series (manufactured by Knowles Electronics) or series 151 made by Tibbetts Industries, incorporating ultra low power preamp within. The receiver 24 can be an ultra miniature type such as an FH or FK series model manufactured by Knowles Electronics, or Series 2600 manufactured by Sonion. Incorporating the receiver and the microphone in a single case can be advantageous and is within the scope of the invention having orthogonal diaphragms for reduced vibration sensitivity.

FIG. 2 shows placement of the hearing device 20 in the ear canal substantially in the bony area and having a length of no more than 12 mm. Hearing device 20 is thus shorter than prior hearing device designs which have axial separation of the microphone and receiver. Because the device is entirely in the bony part, canal deformations in the cartilaginous area 11 do not impact the device directly. Another advantage may be the use of the tapered oval battery 27 to lead the device into the ear canal, thus enabling a more comfortable insertion of the hearing device. The use of a tapered oval battery 27 may be particularly useful in canals, which are narrow, highly contoured or with severe bends. An oval battery perimeter can mimic the oval cross section of the ear canal and can lead to improved fit and maximum volumetric energy efficiency, compared to the typical button-cell used in conventional hearing aids. A handle 31 in the form of a removal cord may be provided for facilitating insertion or removal of the hearing device. The desired length of 12 mm of less refers to the two rigid edges of the overall assembly and does not necessarily include the removal cord, which can be made flexible and non-obtrusive.

FIG. 6 shows the cross sectional view of the sound conduction tube 25 having a D-shaped cross section with long diameter DL and a short diameter Ds for reducing the profile of the hearing device when inserted in the ear canal. The inside long diameter may be preferably less than 2.5 mm and short inside diameter preferably 1 mm or less.

The extended wear canal hearing device of the present invention is preferably disposable and worn for at least 2 months. After depletion of the battery or end of life due to contamination, the hearing device can be disposed of and replaced with a new device if so desired. The most medial surface of the device may be placed preferably approximately 3 mm from the eardrum and typically in the range of 2-5 mm from the eardrum. Due to exceptional proximity to the eardrum of wearer, a physician or a hearing professional is preferably relied on for inserting the device to ensure safe placement and prevent inadvertent damage to the eardrum or the ear canal. To maximize the longevity of the disposable hearing device, all components within may be encapsulated and proofed to withstand water and debris present in the ear canal.

In another embodiment of the invention, the microphone and the speaker are adjacently positioned in a medial assembly medial to the battery. This embodiment can utilize the same principle of providing orthogonal diaphragms for the transducers but in a medial assembly instead of a lateral assembly as disclosed above. The resulting device can be 12 mm or less for fitting exclusively in the bony part of the ear canal for most individuals.

Although presently contemplated best modes of practicing the invention have been described herein, it will be recognized by those skilled in the art to which the invention pertains from a consideration of the foregoing description of presently preferred and alternate embodiments and methods of fabrication thereof, that variations and modifications of these exemplary embodiments and methods may be made without departing from the true spirit and scope of the invention. Thus, the above-described embodiments of the invention should not be viewed as exhaustive or as limiting the invention to the precise configuration or technique disclosed. Rather, it is intended that the invention shall be limited only by the appended claims and the rules and principles of applicable law.

What is claimed is:

1. A hearing device for placement entirely in the ear canal for extended wear therein, said hearing device comprising:

a. a power source;

b. an amplifier;

c. a microphone having a microphone diaphragm responsive to sound entering the ear canal; and d. a speaker having a speaker diaphragm for generating amplified sound;

wherein the hearing device defines an overall length, a lateral portion that occupies the lateral 50 percent of the overall length and a medial portion that occupies the medial 50 percent of the overall length;

wherein at least a portion of the power source is located within the medial portion; and wherein said microphone and speaker are combined adjacently and longitudinally aligned in an assembly that is at least partially disposed within the lateral portion of said hearing device and arranged so as to minimize cross vibrations from said speaker to said microphone when said speaker is excited by said amplifier.

2. The hearing device of claim 1, wherein said speaker and said microphone are arranged so that the microphone diaphragm and the speaker diaphragm are positioned in orthogonal planes.

3. The hearing device of claim 1, wherein said power source comprises a battery.

4. The hearing device of claim 3, wherein the battery has an oval cross section and tapered medial end.

5. The hearing device of claim 1, wherein an acoustic output of said speaker is acoustically coupled to a residual volume between a medial end of the hearing device and the tympanic membrane via a narrow sound conducting channel.

6. The hearing device of claim 5, wherein said sound conducting channel comprises a tube with D-shaped cross section having an inside short diameter of 1 mm or less.

7. The hearing device of claim 1, wherein the hearing device has a length 12 mm or less as measured from a lateral end of the hearing device to a medial end of the hearing device when the hearing device is placed entirely in the ear canal for extended wear therein, wherein the microphone and speaker are disposed at the lateral end and the power source is medial of the microphone and the speaker.

8. The hearing device of claim 7, wherein the microphone and speaker form the lateral end.

9. The hearing device of claim 1, wherein the hearing device is adapted to be placed entirely in the bony part of the ear canal.

10. The hearing device of claim 1, wherein said speaker comprises a dual diaphragm for reducing speaker case vibrations.

11. The hearing device of claim 1, wherein the hearing device is adapted to be disposable and discarded after at least two months of wear in the ear canal.

12. The hearing device of claim 1, wherein components within the hearing device are encapsulated and proofed to withstand water and debris present in the ear canal.

13. The hearing device of claim 1, further comprising a viscoelastic damper disposed between said microphone and said speaker, the viscoelastic damper adapted to reduce vibration coupling therebetween.

14. The hearing device of claim 1, wherein the hearing device is adapted to be positioned in the ear canal by a physician or a hearing aid professional.

15. An extended wear hearing device for placement entirely in the bony part of the ear canal, the hearing device comprising a transducer assembly comprising a. a speaker defining a longitudinal axis and having a speaker diaphragm for producing audible vibrations;

b. a microphone defining a longitudinal axis adjacent to said speaker, the microphone having a microphone diaphragm oriented substantially orthogonal to the speaker diaphragm;

c. a battery; and d. an encapsulant in which said speaker, microphone and battery are encapsulated, said encapsulant having a generally oval cross-sectional shape defining a major axis and a minor axis;

wherein said extended wear hearing device defines a length of 12 mm or less; and wherein said speaker and said microphone are arranged such that their respective longitudinal axes are parallel and are spaced from one another in the major axis direction.

16. The extended wear hearing device of claim 15, wherein the hearing device is adapted to be worn in the ear canal for at least 2 months.

17. A hearing device for placement entirely in the ear canal for extended wear therein, said hearing device comprising:

a. a power source;

b. an amplifier;

c. a microphone having a microphone diaphragm responsive to sound entering the ear canal; and d. a speaker having a speaker diaphragm for generating amplified sound;

wherein said microphone and speaker are combined adjacently in an assembly disposed within a lateral portion of said hearing device and arranged so as to minimize cross vibrations from said speaker to said microphone when said speaker is excited by said amplifier; and wherein the power source is medial of the microphone and the speaker.

18. The hearing device of claim 17, wherein the power source comprises a battery.

19. The extended wear hearing device of claim 15, wherein the battery is medial of said speaker and said microphone.

20. A hearing device, comprising:

a core defining a longitudinal axis defining a medial/lateral direction and including an encapsulant, and a microphone with a microphone diaphragm, a speaker and a battery within the encapsulant, the encapsulant defining a core exterior that in a cross-section perpendicular to the longitudinal axis has a major axis and a minor axis, the major axis defining an inferior/superior direction and the minor axis defining a anterior/posterior direction, and the microphone, speaker and battery being positioned relative to one another such that at least two of the microphone diaphragm, speaker and battery have an inferior/superior spatial relationship with portions thereof coextensive along a common portion of the longitudinal axis, and the battery is medial of the microphone and speaker; and at least one seal carried on the core exterior.

21. A hearing device as claimed in claim 20, wherein the core defines a medial end, the hearing device further comprising:

a sound tube that extends medially from the speaker to the medial end of the core.

22. A hearing device as claimed in claim 20, wherein the microphone and speaker have an inferior/superior spatial relationship.

* * * * *